US006062616A

United States Patent [19]

Smolarski

[11] Patent Number: 6,062,616

[45] Date of Patent: May 16, 2000

[54] DOOR HANDLES

[75] Inventor: Morris Smolarski, South Caufield, Australia

[73] Assignee: Ripponlea Australia Pty Ltd, Clayton, Australia

[21] Appl. No.: 09/182,461

[22] Filed: Oct. 30, 1998

[51] Int. Cl.[7] ..... E05B 15/02

[52] U.S. Cl. ..... 292/356; 292/348

[58] Field of Search ..... 292/347–349, 292/356

[56] References Cited

U.S. PATENT DOCUMENTS

| | | | |
|---|---|---|---|
| 629,123 | 7/1899 | Davis | 292/356 |
| 738,096 | 9/1903 | Caley | 292/356 |
| 745,568 | 12/1903 | Caley | 292/356 |
| 2,459,920 | 1/1949 | Clark | 292/356 |
| 4,460,204 | 7/1984 | Olsen | 292/356 |

FOREIGN PATENT DOCUMENTS

| | | | |
|---|---|---|---|
| 737263 | 7/1943 | Germany | 292/356 |
| 1036704 | 8/1958 | Germany | 292/356 |
| 1036705 | 8/1958 | Germany | 292/356 |
| 960 771 | 6/1964 | United Kingdom | 292/356 |
| 1 496 934 | 1/1978 | United Kingdom . | |
| 2 113 319 | 8/1983 | United Kingdom . | |
| 2 272 028 | 5/1994 | United Kingdom . | |

*Primary Examiner*—B. Dayoan
*Assistant Examiner*—Gary Estremsky
*Attorney, Agent, or Firm*—Larson & Taylor

[57] ABSTRACT

A door handle assembly (10) includes at least one face plate (11) arranged to be secured to the face of a door, and a handle (12) adapted to be mounted on the face plate to be axially rotatable thereto. The handle includes a shank (17) that extends through the face plate. The face plate has a boss (21) adapted to support a bearing mounted on the shank to allow axial rotation thereto and a spring to hold the shank (17) against the face plate. The bearing is accurately located in a recess in the boss (21) of the face plate (11), and the handle (12) and the spring engage opposite ends of the bearing so that the location of the handle against the face plate is independent of the thickness of the face plate.

10 Claims, 2 Drawing Sheets

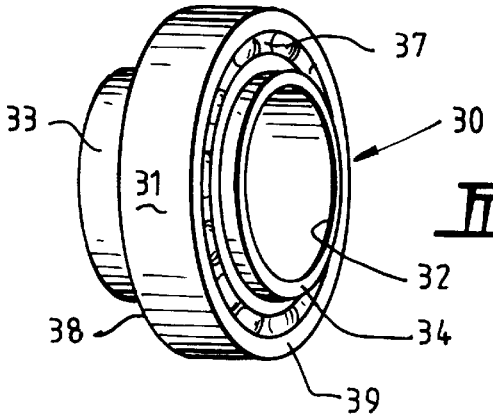
FIG. 1.
FIG. 2.
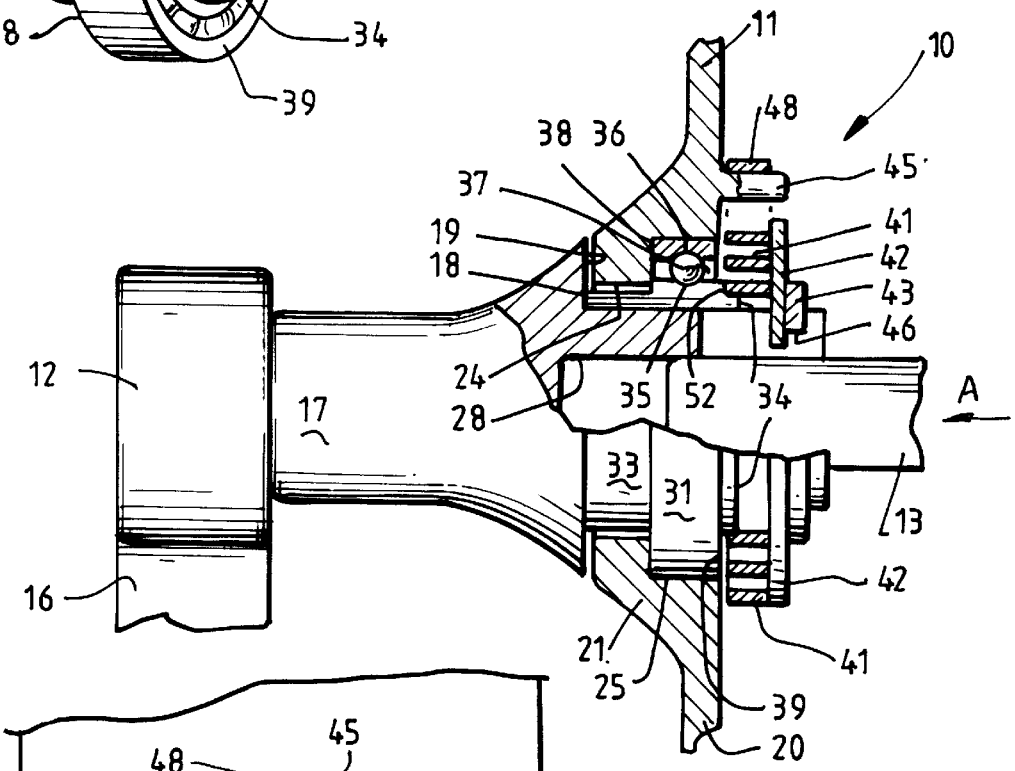
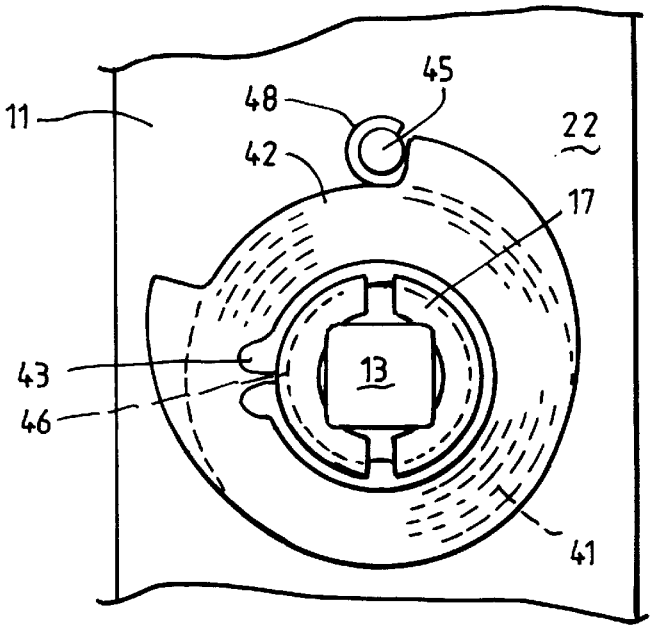
FIG. 3.

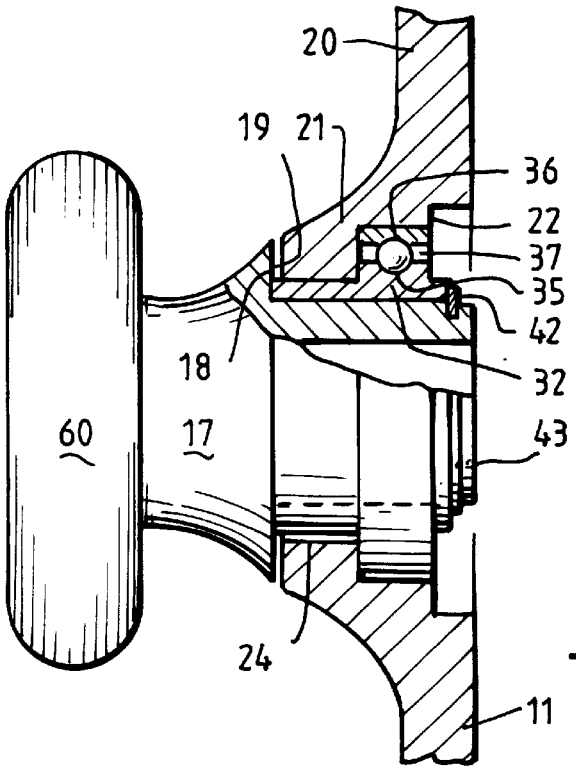
FIG. 4.
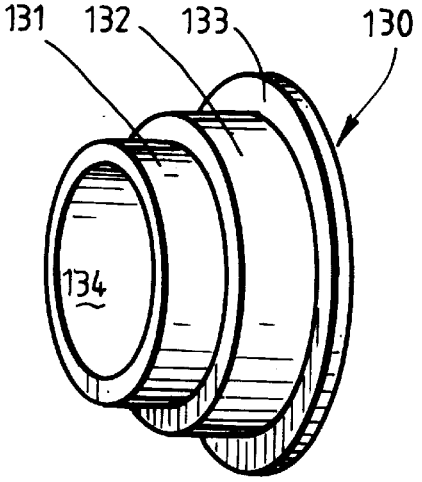
FIG. 5.
FIG. 6.
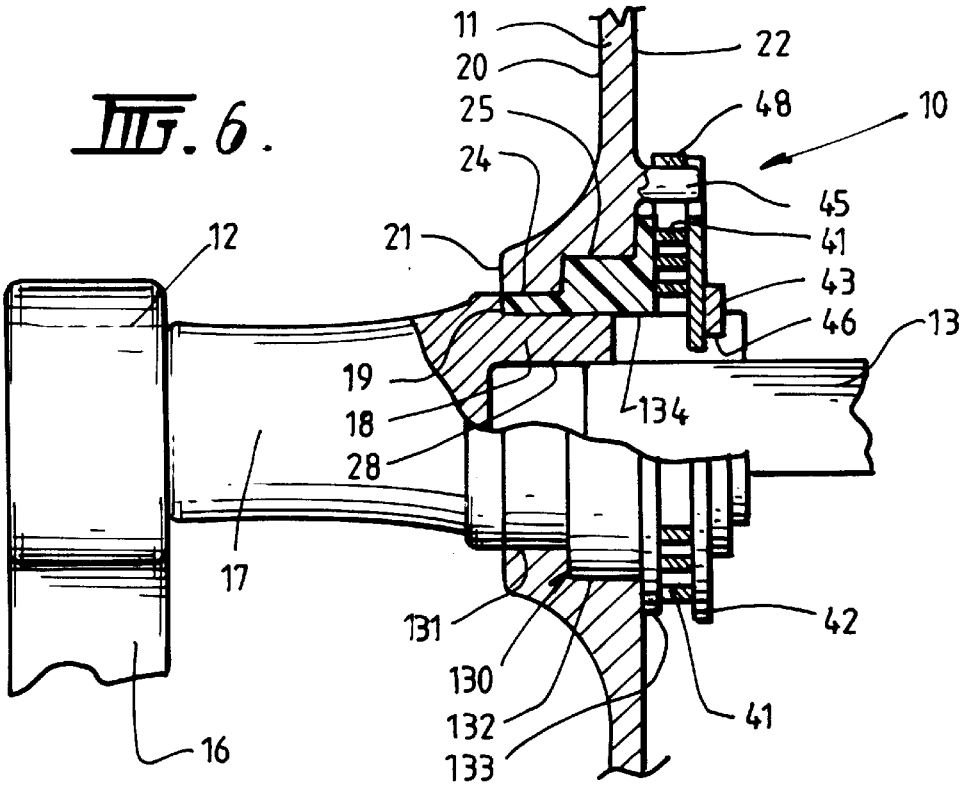

DOOR HANDLES

FIELD OF INVENTION

This invention relates to improvements in or relating to door handles.

DISCUSSION OF PRIOR ART

A common form of door handle comprises a lever or knob that is mounted for axial rotation about a plate that is screwed onto the face of the door. The plate is often cast in brass through a process known as sand casting and includes a projecting boss through which a hollow shank of the lever extends to be rotatable thereto. The interior of the shank is often a non-rotatable fit on a shaft that extends through the door and the associated lock/latch assembly so that rotation of the lever rotates the shaft to operate the lock/latch. It is common to use a nylon bush which acts as a bearing between the exterior of the shank and the interior of the boss. The part of the shank that extends inwardly of the plate sometimes supports a coil spring and an outer washer with a circlip holding the assembly together so that the handle can rotate relative to the plate against the coil spring. In another form there is no spring and a knob is free to axially rotate.

A problem with these types of construction is that it is difficult to ensure uniformity of thickness in the casting process of the plate. It has thus proved necessary to use spacer washers between the circlip and the nylon bush to ensure that the handle is not a loose fit against the plate. It is these problems that have brought about the present invention.

SUMMARY OF THE INVENTION

According to the present invention, there is provided a door handle assembly comprising at least one face plate arranged to be secured to the face of a door, a handle adapted to be mounted on the face plate to be axially rotatable thereto, the handle including a shank that extends through the face plate, the face plate having a boss adapted to locate a bearing mounted on the shank to allow axial rotation thereto and holding means to axially hold the shank against the face plate characterised in that the bearing is located in a recess in the boss of the face plate and the handle and holding means engage opposite ends of the bearing so that the location of the handle against the face plate is independent of the thickness of the face plate.

DESCRIPTION OF THE DRAWINGS

Embodiments of the present invention will now be described by way of example only with reference to the accompanying drawings in which:

FIG. 1 is a perspective view of a roller bearing assembly for use with a door handle assembly, FIG. 2 is a cross-sectional view of the door handle assembly showing the bearing assembly in position, and FIG. 3 is an end on view of the door handle assembly viewed in the direction of the arrow A in FIG. 2.

FIG. 4 is a cross-sectional view of an alternative form of door handle assembly, FIG. 5 is a perspective view of a nylon bush for use with a door handle assembly, and FIG. 6 is a cross-sectional view of the door handle assembly showing the location of the bush.

DESCRIPTION OF THE PREFERRED EMBODIMENTS

A door handle assembly 10 as shown in FIGS. 1 and 2 of the accompanying drawings comprises a face plate 11 that is secured to the face of the door (not shown), the face plate 11 in turn supporting a handle 12 that extends through the face plate 11 and the door to engage a locking and latching mechanism (not shown) via a spindle 13 which is driven by the handle 12. The handle 12 is secured to the face plate 11 to be pivotable relative to the face plate to drive the lock or latching mechanism.

The face plate 11 is cast in brass usually by use of a sand casting technique. Alternatively the face plate could be forged. The plate 11 has a planar surface portion 20 that merges into a projecting hollow boss 21 through which that handle 12 is secured to be pivotable about the axis that extends through the centre of the boss 21. The interior surface 22 of the face plate 11 terminates in a peripheral border (not shown) that rests against the door surface. The interior surface 22 of the boss 21 includes a stepped recess 25 of circular cross-section which is adapted to locate the outer race 31 of a roller bearing assembly 30 that operates as a bearing between the handle 12 and the internal surface 24 of the boss 21 of the face plate 11. The handle 12 is usually also manufactured in brass and comprises a lever 16 that projects at right angles to a shank 17 that has a stepped down cylindrical portion 18 that extends into the boss 21 of the face plate 11. The shoulder 19 defined by the stepped down portion 18 of the shank 17 forms an abutment surface that prevents inward movement of the handle 12 relative to the face plate 11. The shank 17 is provided with an internal bore 28 of square cross-section which is adapted to slidingly support a squared spindle 13 that extends through the door and a suitable locking or latching mechanism, not shown, to engage a similar handle and face plate assembly on the other side of the door. The handle 12 is arranged to pivot relative to the face plate 11 about a spring 41 and the assembly is held together through use of a washer 42 and circlip 43 arrangement shown in FIGS. 2 and 3.

The bearing assembly 30 that is located between the interior of the boss 21 of the face plate 11 and the shank 17 of the handle 12 comprises, as shown in FIG. 1 an inner cylindrical sleeve 32 having axially inner and outer ends 33 and 34. The outer surface of the sleeve 32 defines an inner race 35 that supports a plurality of ball bearings 36 against an outer race 31. The balls 36 being held within the races 35 and 31 by a cage 37. The inner and outer races 35 and 31 define inner and outer faces 38 and 39. The inner surface of the sleeve 32 is a force fit on the stepped down portion 18 of the shank 17 of the handle and abuts the shoulder 19 defined by the stepped down portion 18. The axially inner face 38 of the races 35 and 31 abuts the wall of the recess 25 and the outer race 31 in a close fit within the recess 25. The outer end 34 of the sleeve 32 projects out of the boss of the handle and defines an annular shoulder 52 with the inner race 35. The location of the bearing assembly 30 ensures that the shank is a free rotating fit within the outer race 31 about the ball bearings 36. The outer end 34 of the sleeve 32 projects outwardly of the inner face of the face plate 11. The coil spring 41 is positioned on the end of the sleeve 32 on the annular shoulder 52. The coil spring 41 ends in a hook 48 that engages an projecting lug 45 that is formed integrally with the face plate 11. The location of the coil spring 41 is such that the coils are spaced from the inner surface of the face plate 11. The washer 42 holds the coil spring 41 against the shoulder 52 of the sleeve 32 and the circlip 43 is arranged to engage within an annular groove in the end of the shank 17 to hold the washer 42, spring 41, handle 12 and face plate 11 together. When the handle 12 is turned the coil spring 41 is tensioned which means that when the turning force is taken off the handle it returns to a neutral horizontal position.

It has proved difficult to accurately determine the thickness of the face plate during the casting process which means that the axial dimension tends to vary from face plate to face plate. Consequently, if the washer 42 that engages the spring 41 also engages and locates on the interior surface of the face plate 11 there is often a need to either insert packing washers to tension the assembly or sometimes a need to remove material from the inner surface of the face plate to ensure that the assembly is not too tight. It is important that there is not too much axial play in the assembly so that the handle is firmly supported yet free for axial rotation. The location and positioning of the bearing races 35 and 31 in the recess 25 and the engagement of the spring 41 on the shoulder 52 at the end of the sleeve ensures that the axial length of the assembly is determined by the dimensions of the bearing assembly 30 and not the dimensions of the face plate 11. Thus, since it is possible to produce the bearing assembly accurately dimensioned there is an opportunity to ensure that the assembly always has a good firm running fit, notwithstanding the fact that there may be fluctuations in the thickness of the plate.

In the embodiment of FIG. 4 the handle is replaced by a knob 60 that is free to rotate and does not drive a spindle. The assembly is much the same as that shown in FIG. 2 except there is no coil spring and the circlip 43 holds a washer 42 against the outer end 34 of the bearing sleeve 32.

In the embodiment shown in FIGS. 5 and 6, the same reference numerals are used for like parts as those shown in FIG. 2. In this embodiment, the bearing is in the form of a nylon bush 130. The nylon bush 130 positioned between the interior of the boss 21 has a face plate 11 and the shank 17 of the handle 12 has a first bearing portion 131, a second larger bearing portion 132 and an end annular flange 133. The first bearing portion 131 is a smooth fit within the exterior portion of the boss 21 and the larger bearing portion 132 is located in machined stepped recess 25 in the boss 21. The interior of the bush 130 defines a cylindrical throughway 134 that allows the shank 17 of the handle 12 to be supported as a sliding fit therein facilitating axial rotation of the shank 17 relative to the face plate 11 without lateral movement. The annular flange 133 on the end of the bush 130 is adjacent the inner surface 22 of the face plate 11 and the coil spring 41 is positioned over the end of the shank 17 of the handle 12. The nylon bush effectively replaces the roller bearing 30 of the first embodiment.

What is claimed is:

1. A door handle assembly comprising at least one face plate having a thickness and being arranged to be secured to a face of a door, a handle adapted to be mounted on the face plate so as to be axially rotatable relative thereto, the handle including a shank extending through the face plate, and a bearing being mounted on the shank, the face plate having a boss which includes a recess and which supports the bearing mounted on the shank to allow axial rotation thereof, and holding means to hold the shank against the face plate, the bearing being accurately located in the recess in the boss of the face plate, the handle and holding means engaging opposite ends of the bearing and the holding means being spaced from, and unengaged with, the face plate so that the location of the handle against the face plate is independent of the thickness of the face plate.

2. The assembly according to claim 1 wherein the bearing defines an inner cylindrical surface mounted on the shank, the bearing including inner and outer races interconnected by a plurality of balls, the outer race being located in the recess in the boss of the face plate.

3. The assembly according to claim 1 wherein the bearing comprises a bush having an inner cylindrical bearing surface with a stepped exterior comprising annuli of increasing diameters defining a first location surface, a second larger location surface and an end flange of cross-section greater than the larger location surface, the second larger location surface locating in the recess in an interior surface of the boss of the face plate.

4. The assembly according to claim 1 wherein the shank drives a spindle.

5. The assembly according to claim 4 further comprising means cooperating with the holding means to bias the handle to a neutral position.

6. The assembly according to claim 5 wherein the holding means comprises a coil spring positioned around the spindle and coupled to an interior surface of the face plate so that rotation of the spindle tensions the spring, a washer being positioned over the spring and being secured thereon by a circlip that locates in a groove in the end of the shank of the handle.

7. The assembly according to claim 1 wherein said bearing includes a shoulder against which said holding means bears.

8. The assembly according to claim 7 wherein said holding means comprises a coil spring, said bearing includes inner and outer races interconnected by a plurality of balls and said shoulder is formed in a portion of said inner race extending away from said handle.

9. The assembly according to claim 1 wherein said bearing includes inner and outer races interconnected by balls and said holding means comprises a circlip engaging said inner race.

10. The assembly according to claim 1 wherein said holding means comprises a coil spring and said bearing means comprises a bushing including a surface extending transversely to the axis of rotation of the shank and against which said coil spring bears.

* * * * *